US005581836A

United States Patent [19]

Kleber

[11] Patent Number: 5,581,836

[45] Date of Patent: Dec. 10, 1996

[54] COMPACT WASHING UNIT AND METHOD OF WASHING AND SANITIZING TRAYS

[76] Inventor: Richard M. Kleber, 9910 Ellis Rd., Clarkston, Mich. 48348

[21] Appl. No.: 391,031

[22] Filed: Feb. 21, 1995

[51] Int. Cl.[6] ..... A47L 15/36

[52] U.S. Cl. ..... 15/77; 15/88.2; 15/88.3; 134/64 R; 134/83; 134/122 R; 134/199

[58] Field of Search ..... 134/64 R, 122 R, 134/83, 64 P, 95.2, 102.8, 122 P, 199; 15/77, 88.2, 88.3

[56] References Cited

U.S. PATENT DOCUMENTS

| | | | |
|---|---|---|---|
| 1,617,833 | 2/1927 | Armstrong . | |
| 2,651,065 | 9/1953 | O'Connor | 16/56 |
| 2,822,635 | 2/1958 | Mears | 134/64 R |
| 3,098,250 | 7/1963 | Creech | 134/64 RX |
| 3,178,745 | 4/1965 | Kleebauer | 15/77 |
| 3,223,097 | 12/1965 | Spaulding | 134/46 |
| 3,643,278 | 2/1972 | Harris et al. | 15/77 |
| 3,679,483 | 7/1972 | Zweig | 134/83 X |
| 3,694,847 | 10/1972 | Hetman et al. | 134/64 R |
| 3,881,209 | 5/1975 | Reinitz | 134/122 R |
| 4,170,240 | 10/1979 | Gentry | 134/199 X |
| 4,281,675 | 8/1981 | Pure | 134/199 |
| 4,454,003 | 6/1984 | Fishman et al. | 134/83 |
| 4,506,687 | 3/1985 | Rosch, III | 134/83 |
| 4,561,144 | 12/1985 | Marais | 15/302 |
| 4,739,780 | 4/1988 | Czaja et al. | 134/122 R |
| 4,832,308 | 5/1989 | Curcio | 15/77 |
| 5,067,192 | 11/1991 | Gueiff et al. | 15/302 |
| 5,075,915 | 12/1991 | Rodriguez | 15/77 |

*Primary Examiner*—Frankie L. Stinson

*Attorney, Agent, or Firm*—Reising, Ethington, Barnard & Perry

[57] ABSTRACT

A compact washing and sanitizing unit and method for cleaning and drying food service trays as well as other articles after being serially loaded in an upright manner in guide tracks that lead through the unit so that the trays process one at a time through adjacent washing and drying stations of the unit. After being manually loaded, an operator by exerting a displacement force on a last loaded tray urges preceding trays through the unit by virtue of their edge-to-edge physical contact.

7 Claims, 4 Drawing Sheets

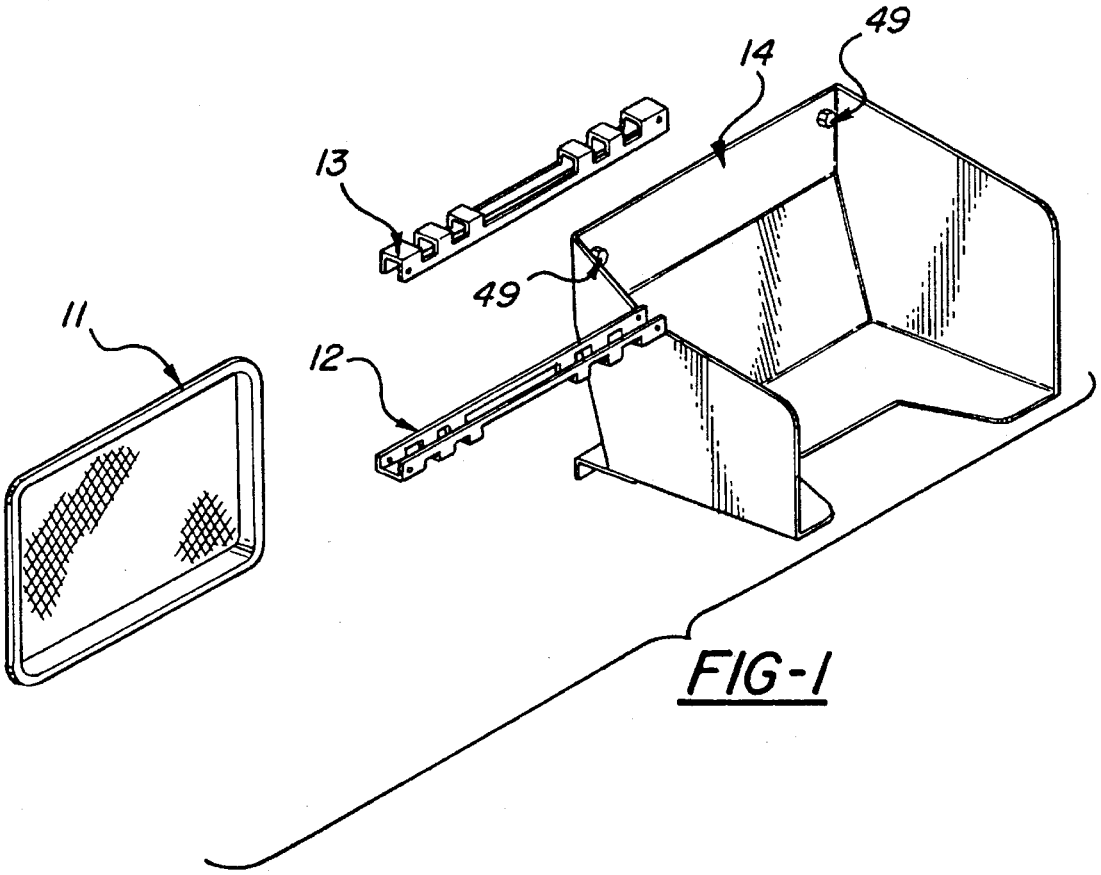
FIG-1
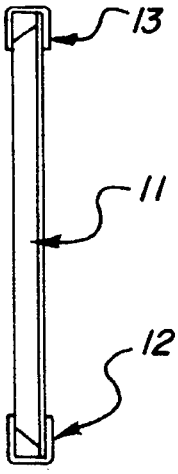
FIG-1b
FIG-1a
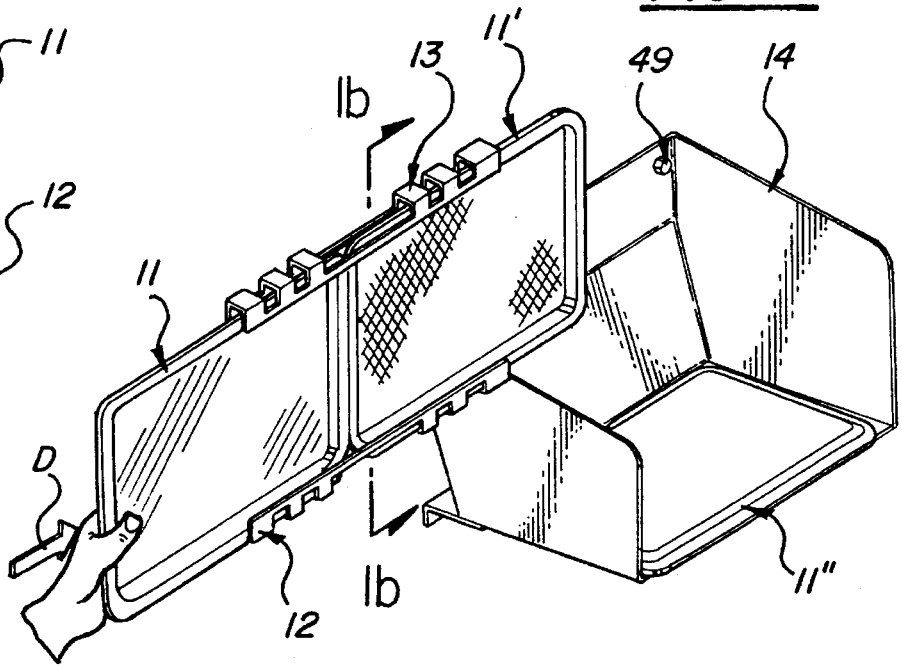

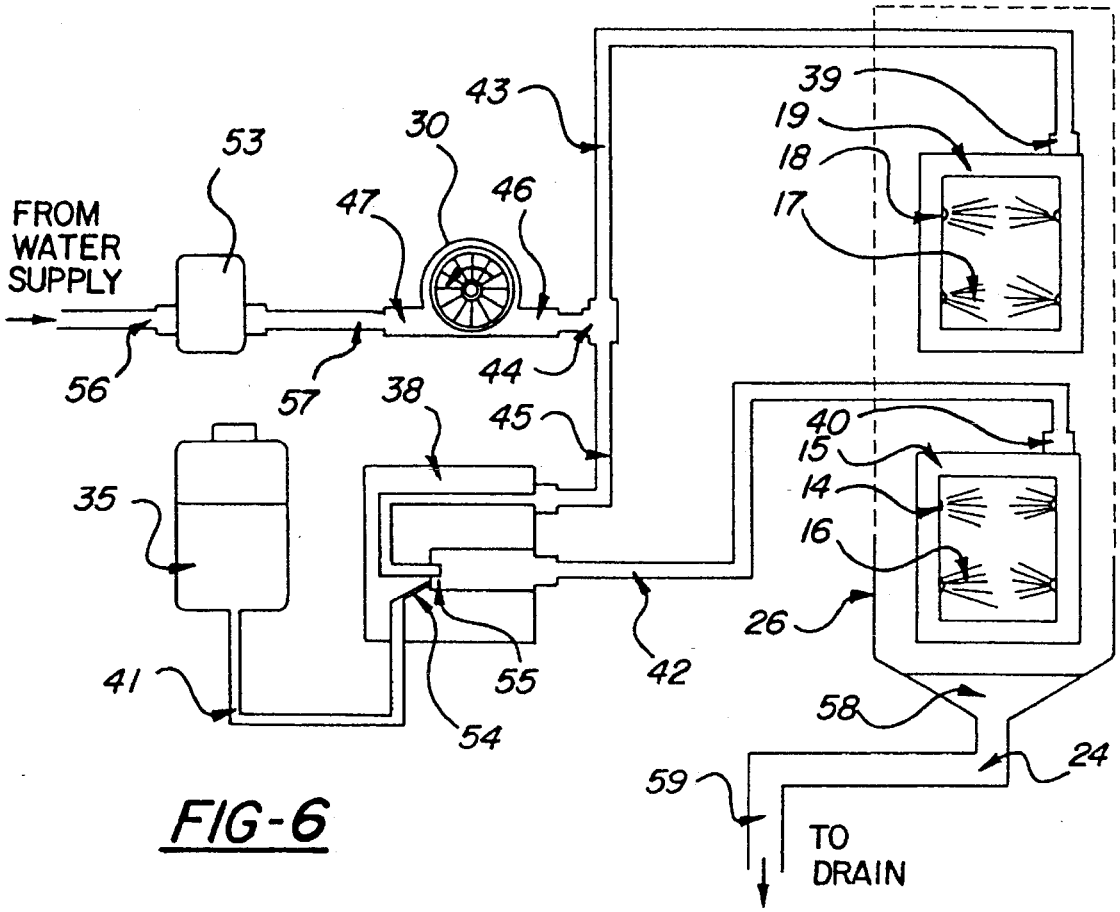
FIG-6
FIG-6a
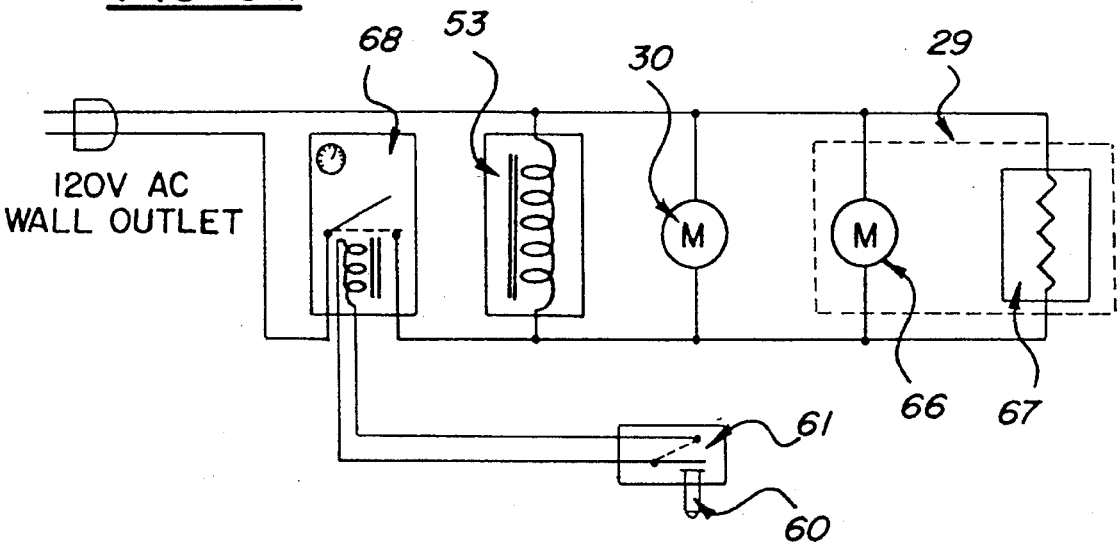

COMPACT WASHING UNIT AND METHOD OF WASHING AND SANITIZING TRAYS

FIELD OF THE INVENTION

The present invention relates to the sanitation of articles such as food service trays and utensils, and more particularly, to a new and improved compact washing, rinsing and drying unit having adjacent fluid washing, rinsing and drying sections which effectively sanitize the articles serially fed and held in an upright manner as they are pushed through the unit.

BACKGROUND OF THE INVENTION

A large industry of rapid service restaurants has evolved with economic advantages over more traditional waitered restaurants. Generally, in such rapid service restaurants permanent food serving plates and utensils are not used since food is served in disposable containers. This relieves the rapid service restaurant from the time and expense of purchasing, using and washing such conventional plates and utensils.

However, the food in the disposable containers of such rapid service restaurants is generally served to the patron on a permanent, reusable tray. Often customers use such trays as food plates as well as a food carrier. The use of trays as food plates, as well as spillage of food and drinks on trays, results in unwanted matter and the contamination thereof. The sanitation practices generally used to clean such trays frequently does not meet higher standards for improved sanitation, and particularly higher standards for low bacterial counts.

SUMMARY OF THE INVENTION

To meet such higher standards, the present invention provides a compact washing, rinsing and drying unit with fast and effective steps for the quick and optimized sanitation of such food service trays and other utensils. The unit of this invention is adapted to be easily retrofitted in most restaurants including those featuring rapid service.

The unit of this invention is designed to readily mount on an interior wall of kitchen or service area so that no floor or counter space is required. The unit may also be adapted to sit on a counter if desired.

In one method of operation, the trays are loaded individually into upper and lower tracks of the unit, in a specific vertical orientation so that the operator can push the load tray on the tracks that traverse the wash chamber of the unit. The operator continues the motion of the tray until the tray can no longer be urged from the input side of the tray washer. To continue the motion of the initial tray, a following or next tray is placed into the threshold or opening of the input side of the unit. As the operator urges the second tray through the wash chamber, it in turn urges the initial tray to continue through the unit and empty out into the receiving hopper for further use in the restaurant. This cycle continues as subsequent trays are washed until the final tray is in the wash chamber of the invention.

Preferably, the physical length of the trays are just slightly longer than the wash, rinse and drying sections of the unit. Accordingly, when washing and drying a single or final tray, and when the operator can no longer conveniently urge the tray through the unit from the input side, the portion of the tray emerging from the opposite side of the unit above the receiving hopper can be manually gripped. The operator can then manually extract the final tray from the wash, rinse and dry chamber of the unit continuing its sanitation in the process.

The preferred embodiment of the present invention provides a unit and method of washing and drying utensils such as food service trays for rapid service restaurants and cafeterias. The unit basically requires only standard electrical current with conventional electrical safety devices. A water supply is required, preferably heated and a standard sink drain is needed for the gravitational removal of wash and rinse water. The unit is designed to readily mount on an interior wall of a restaurant kitchen or service area so that no floor or counter space is required for the installation of the tray washer.

In the preferred sanitation process of this invention, the tray is inserted through the input threshold and into the wash chamber where it is exposed to a high pressure spray of hot water mixed with a commercial liquid detergent. As the operator physically urges the tray further through the device, it is next passed through a set of stationary scrub brushes. The motion caused by the urging of the operator produces a frictional interface between the tray surface and the bristles of the scrub brush for efficient scrubbing of food and other foreign matter from the trays. The operator can effect additional scrubbing action for difficult contamination on a tray by manually reversing the direction of motion of a tray repeatedly in a back and forth manner so that the bristles of the scrub brushes physically contact and dislodge the food particles and difficult contamination.

With further urging, the tray next passes into a high pressure spray of rinse water which completely removes foreign material loosened by the scrub brushes and the residue of the initial spray of water and liquid detergent. The final operation in the first section of the wash and sanitizing chamber is the exposure of the tray to a flow of heated air generally directed in a downward direction across the tray to aid in the gravitational removal of the rinse water from the tray surface.

Finally, the tray passes through the exit threshold and out of the wash and sanitizing chamber. At this threshold the tracks that have been restricting the position of the tray through the wash chamber end. The tray is then free to drop into the accumulating hopper. The physical shape of the accumulating hopper controls the motion of the tray in its gravity drop and directs its orientation at rest. The sanitation of the tray is then completed and as subsequent trays are similarly processed they will nest on top of one another. The trays can be removed from the accumulating hopper at any time for their return to service in the restaurant.

An object of this invention is to provide a low cost wash, rinse and dry unit for the improved sanitation of service trays in the food service industry.

An additional object of the invention is to provide a new and improved food service tray sanitizing unit, and a new and improved continuous process for the sanitization of such trays which includes the removal of sanitized trays from the unit while the unit is in use and without interrupting the sanitizing operation.

A further object of the invention is to provide a new and improved compact tray washing unit which can be readily installed in a wide range of locations and requires minimal electrical and water utilities from a food service establishment. More particularly, this invention requires only standard electrical service and water supply as well as a standard sink drain.

A further object of this invention is to provide a new and improved service tray washing unit configured so as to be wall mounted eliminating the requirement for floor space or counter space.

It is a further object of the invention to provide a new and improved utensil sanitizing unit configured to rest on a counter top or moveable service cart.

It is another feature, object and advantage of this invention to provide a new and improved washing unit and method for serially washing a plurality of discrete articles, such as serving trays, one at a time in which the articles are serially loaded in a train so that they have inter-edge contact in an upright location allowing one of the articles remote from an entrance portal of the washing unit to be manually contacted and displaced so that the preceding articles can be serially moved past washing and rinsing stations where the articles are washed and rinsed and a dryer station where the articles are dried and then through an exit in the unit where the articles can be removed and reused.

These and other features, object and advantages of this invention will become more apparent from the following detailed description and drawings.

BRIEF DESCRIPTION OF THE DRAWINGS

FIG. 1 is an exploded pictorial view of some innermost components of the washer and drying unit of this invention;

FIG. 1*a* is a view similar to that of FIG. 1 illustrating trays being fed by the support and guide tracks of the washer and dryer unit into a collection hopper;

FIG. 1*b* is a cross-sectional view taken generally along sight lines 1*b*—1*b* of FIG. 1*a;*

FIG. 6 is a diagrammatic view of the washing, rinsing and drying unit of this invention; and FIG. 6*a* is a diagram of an electrical control circuit used in the washing, rinsing and drying unit of this invention.

DETAILED DESCRIPTION OF THE PREFERRED EMBODIMENT

Figure 2:
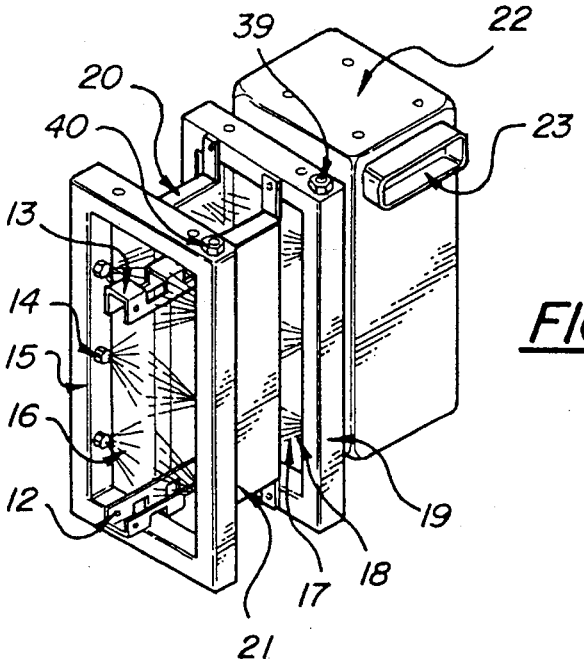
FIG. 2 is an exploded pictorial view of the washing, rinsing and drying elements of the sanitizing chamber of the unit of this invention.

FIG. 1 shows a typical food service tray 11 of the type that the tray washer is designed to sanitize. Lower track 12 and upper track 13 align vertically and establish the orientation and path of the tray through the sanitizing chamber of the invention. After traversing through the sanitizing chamber as provided by the wash, rinse and drying chamber, the tray is allowed to drop freely from the track set, defined by upper and lower tracks 12 and 13, into the receiving hopper 14. The shape and contours of the receiving hopper 14 orient, guide and nest the sanitized trays for convenient removal for reuse in the food service establishment.

Wall mounting fasteners 49 are employed to fasten the receiving hopper 14 to the wall of the restaurant or service area (not shown). FIG. 1*b* shows the side edges or flanges connected by webs of the vertically-spaced tracks 12, 13 for receiving and embracing the opposing side edges of each of the trays 11. FIG. 1*a* illustrates an optimized level of containment that the track set 12 and 13 offer tray 11 as it traverses through the invention. Clearances between the track set 12 and 13 and tray 11 are only enough to allow for unrestricted motion, and yet provide for guided movement of the tray 11 along the length of track set 12 and 13. FIG. 1*a* shows the direction of trays 11 and 11' as they traverse through the wash chamber of the invention on track set 12 and 13 as indicated by arrow D.

The tray containment shown in FIG. 1*a* that the track set 12 and 13 provides for trays 11 and 11' ensures that as tray 11 is urged by the operator in direction of arrow D, similarly tray 11' is urged and displaced ahead of it through the wash chamber of the invention. As tray 11 is further urged and displaced along track set 12 and 13, tray 11' will reach the end of the containment offered by track set 12 and 13 and drop freely into the receiving hopper 14. The shape of the walls of the receiving hopper 14 are such that the hopper will funnel and guide tray 11' to nest on top of tray 11".

FIGS. 2 and 6 show the internal components of the wash chamber portion of the preferred embodiment of the invention. As the food service tray traverses the wash chamber of the invention, it is initially power scrubbed by a directed, pressurized spray field 16 of a mixture of water and liquid detergent emitting from spray nozzles 14 of wash water manifold 15. The mixture of water and liquid detergent enters the wash water manifold 15 through fitting 40.

As the tray progresses further in the wash chamber portion of the unit traverses between the two interfacing and stationary scrub brushes 20 and 21. The bristles of these two brushes interface with one another to define a narrow passage less than the thickness of the tray so that they scrub and clean both sides of the tray.

Accordingly, the motion of the tray in reference to the stationary scrub brushes 20 and 21 provides the scrubbing action to remove solid matter from the tray. Further movement in the wash chamber portion in the invention traverses the tray into the directed, pressurized spray field 17 of rinse water emitting from spray nozzles 18 of rinse water manifold 19. Rinse water enters the rinse water manifold through fitting 39.

Further movement in the sanitizing chamber portion of the invention traverses the tray into a stream of heated air for drying which is circulates through from ducting system 22. Ducting system 22 is pressurized through opening 23.

Figure 3:
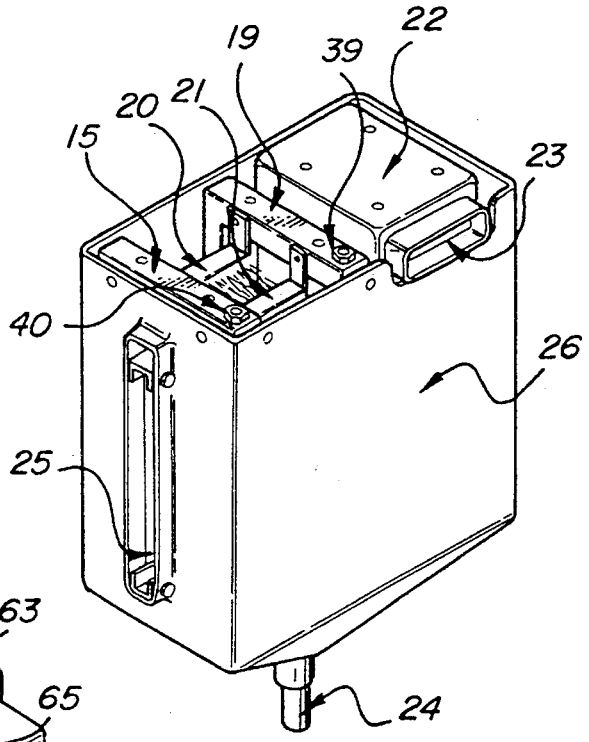
FIG. 3 is a pictorial view of the washing and drying unit with its surrounding outer housing and wash chamber.

FIG. 3 shows a fluid containment device or housing 26 that defines the perimeter of the wash chamber portion of the invention. The wash and rinse fluids are voided from the fluid containment device 26 by gravitational pull through a standard sink drain apparatus 24 connected to a service drain (not shown).

The trays are inserted into the wash chamber portion of the invention through threshold 25 and exit through a similar threshold on the opposite side of the machine (hidden in this view). The tray then freely drops into the receiving hopper 14 which guides the trays onto one another in stacked arrangement and supported by the floor of the hopper.

Figure 4:
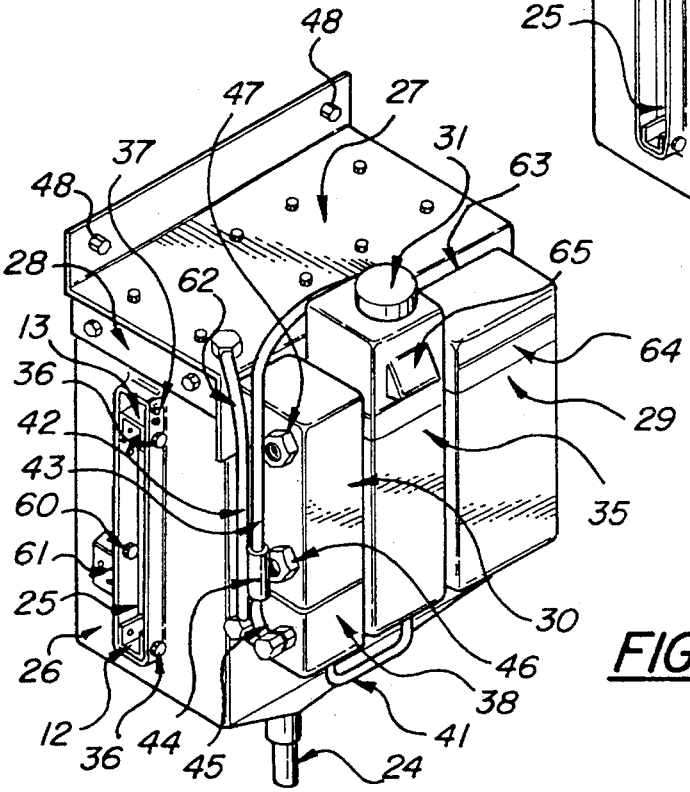
FIG. 4 is a pictorial view of the primary structural components of the invention with supply and drying unit for the tray washing components secured thereto.

FIG. 4 shows a metallic top cover 28 for the fluid containment device 26. A structural, formed metallic plate 27 is depicted which supports the fluid pressurization device 30 with fasteners 48. The formed metallic plate 27 also supports the liquid detergent reservoir 35 and heated air source 29 with band bracket 64.

The liquid detergent reservoir 35 is further restrained by surface detail 65 reacting on band bracket 64. Restrained in position by band bracket 64, the heated air source 29 supplies heated air to the ducting system 22 of FIG. 2 through opening 63 in the formed metallic plate 27. Opening 63 in the formed metallic plate 27 is in axial alignment with opening 23 in FIG. 2. The structural, formed metallic plate 27 also provides the means to mount the invention to a vertical wall surface (not shown) with fasteners 48. The metallic top cover 28 is welded to the formed metallic plate 27 and supports the fluid containment device 26. The formed metallic plate 27 also supports the wash water manifold 15, rinse water manifold 19, and ducting system 22 with common fasteners.

The water from the water supply (not shown) enters the fluid pressurization device 30 through input fitting 47. Pressurized water exits the fluid pressurization device 30 through output fitting 46 into tee fitting 44. Tee fitting 44 directs pressurized water to rinse water tube 43 and mixer valve tube 45. The pressurized water that flows through the rinse water tube 43 flows through the input fitting 39 on the rinse water manifold 19 of FIG. 4.

The pressurized water that flows through the mixer valve tube 45 enters the mixer valve 38 where it combines with a controlled amount of liquid detergent. The liquid detergent flows into the mixer valve 38 from the liquid detergent reservoir 35 through the soap tube 41. The pressurized mixture of water and detergent flow through the pressurized wash tube 42 into the wash water manifold 15 through input fitting 40 of FIG. 4.

FIG. 4 also shows the attachment of track set 12 and 13 to the fluid containment device 26 with fastener sets 36. The lower track 12 is fixed in relationship to the wash chamber with only one location set of holes for the fastener set 36. The upper track 13 is capable of being mounted in a variety of locations as shown in the set of fastener holes 37 in fluid containment device 26. The variety of the set of fastener holes 37 changes the dimension between lower track 12 and upper track 13. The change in dimension between the lower track 12 and the upper track 13 gives the unit the adjustability and capability to clean and dry food service trays of different standard dimensions.

The fluid containment device 26 also supports the initiation switch 61 with common fasteners. Actuation rod 60 of initiation switch 61 penetrates into the threshold 25. As trays are loaded into the device through the threshold 25, the actuation rod 60 closes the electrical contacts of initiation switch 61. The closure of the electrical contacts of the initiation switch 61 brings the electrical system of the device to power as described in the detailed description of FIG. 6*a*.

Figure 5:
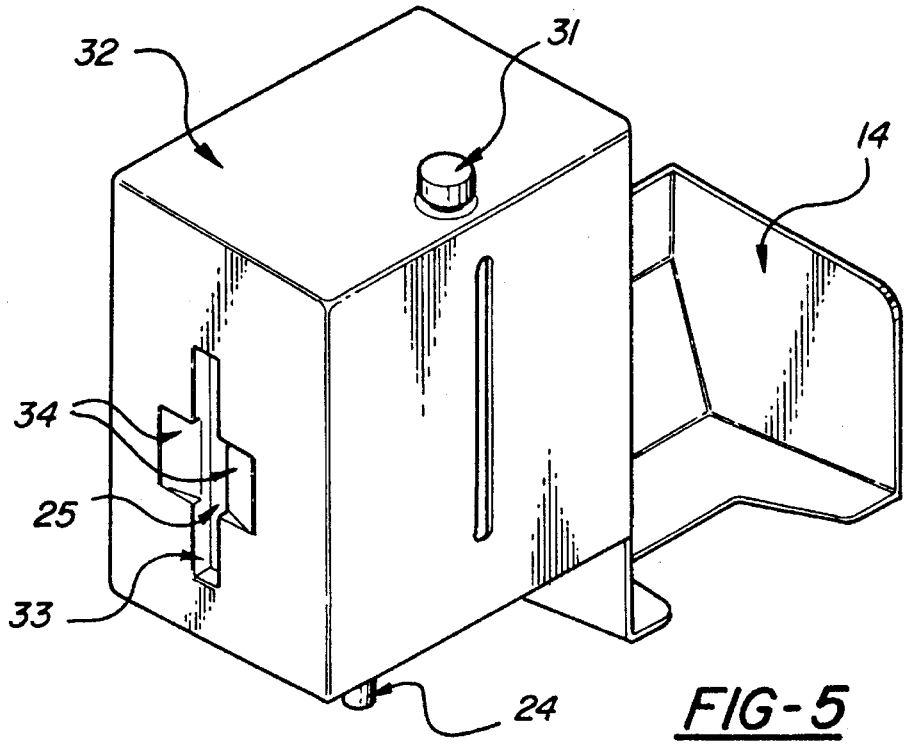
FIG. 5 is a pictorial view of a finished unit with a housing that defines the exterior appearance thereof with a tray receptacle attached thereto.

FIG. 5 shows a completely assembled version of the invention. The wash chamber cover 32 defines the outer appearance of the invention. The wash chamber cover 32 also protects the user from the internal components of the invention as well as protecting the internal components from contact with foreign materials.

Threshold opening 33 is in alignment with threshold 25 shown in FIG. 3. Threshold opening 33 has the additional detail of recesses 34 to allow easier insertion of trays into the preferred embodiment of the unit. Threshold opening details similar to details 33 and 34 are on the opposite side of the wash chamber cover 32 which are not visible in this view of the device. A removable lid or cap 31 is provided for the neck of liquid detergent reservoir 35 which extends through wash chamber cover 32 to allow for the access to the reservoir and the easy addition of liquid detergent without significant disassembly of the invention.

Figure 5A:
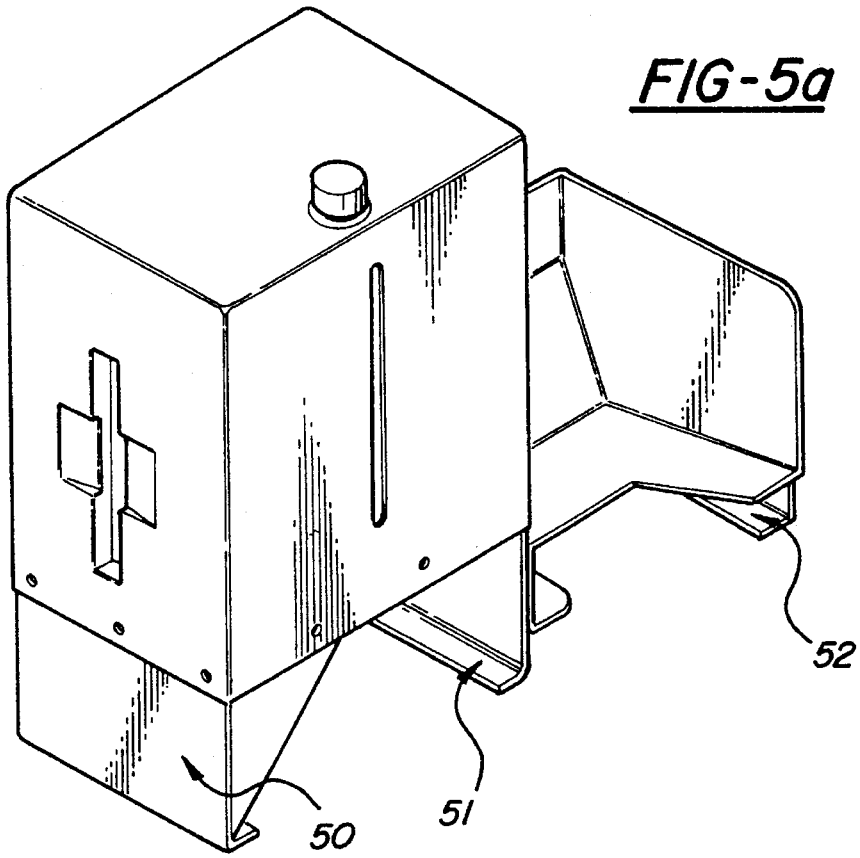
FIG. 5*a* is a view similar to FIG. 5 but with support legs depending from the unit.

FIG. 5*a* shows a completed unit with adapter legs 50, 51 and 52 fastened to the invention. This configuration would allow the invention to rest on a counter or moveable service cart if the end user did not desire a wall mounted device.

FIG. 6 is a schematic diagram of the fluid systems for the device. The water supply from the establishment is piped into the electrical solenoid valve 53 through common water plumbing hardware 56 as appropriate local practices dictate. As an electrical impulse signals demand for water in the device, water flows through supply tube 57 into the fluid pressurization device 30 through input fitting 47. The fluid pressurization device 30 is a commercially available rotary vein pump with an integral electrical motor, which urges pressurized water through output fitting 46 into the tee fitting 44. The tee fitting 44 diverts a portion of the pressurized water through the rinse water tube 43 and input fitting 39 into the rinse water manifold 19.

The pressurized water further flows out of the rinse water manifold through spray nozzles 18 becoming pressurized spray field 17. Tee fitting 44 directs the remaining portion of pressurized water through the mixer valve tube 45 into mixer valve 38. As pressurized water flows through the internal passage of mixer valve 38 it establishes a vortex 55 which creates a low pressure condition locally in the vortex 55.

The low pressure area draws liquid detergent through metering tube 54 which is also an internal passage of mixer valve 38. Liquid detergent is supplied to the mixer valve through the soap tube 41 flowing from the liquid soap reservoir 35.

The mixture of pressurized water and liquid detergent flow through the pressurized wash tube 42 and the input fitting 40 into the wash water manifold 15. The mixture of pressurized water and liquid detergent further flows out of the wash water manifold through spray nozzles 14 becoming pressurized spray field 16. Spray fields 17 and 16 are directed at trays (not shown) passing through the fluid containment device 26.

After striking the trays, the water and liquid soap/water mixture fall via gravity to the lower portion 58 of the fluid containment device 26 where gravity further urges the water and liquid soap mixture through standard sink drain apparatus 24 to the establishment's drainage system through common plumbing hardware 58 as appropriate local practices dictate.

FIG. 6*a* is an electrical schematic for the device. The device requires a standard 120 v ac wall socket for power. The power circuit in the device is self initiated. As the operator loads a tray into the device, it deflects the actuation rod 60 to close the contacts of initiation switch 61. The closure of the contacts of initiation switch 61 allows the excitation of the coils of timer relay 68. The excited coils of the timer relay in turn close the contacts of the timer relay 68 which allow current to flow through the power circuit of the device.

The common timer relay 68 which allow current to flow through the power circuit of the device. The common timer relay 68 has an internal clock that maintains the contact closure of the timer relay 68 for a preset amount of time.

Each time a tray is loaded into the device the internal clock of the timer relay 68 is reset to the preset time. The preset time is slightly longer than the typical time that the operator uses to wash a single tray with the device. The result of the preset time and the timer relay 68 is that the device will run continuously as trays are loaded sequentially through the device, and the device will self depower soon after the last sequential tray has been washed and dried by the device.

When the contacts of the timer relay 68 reach closure electrical power flows to a series of electrical apparatuses in the device. Electrical power flows to the coils of the electrical solenoid valve 53 which in turn allows the water supply to flow into the fluid system of the device.

When the internal contacts of the timer relay 68 reach closure, electrical power also flows to the motor of the fluid pressurization device 30 which pressurizes the fluid system of the device. When the internal contacts of the timer relay 68 reach closure, electrical power flows to the heated air source 29. The two electrical components of the heated air source 29 are the fan motor 66 and the heater elements 67. The fan motor 29 urges air through the heater elements 67, and further through the opening 23 of the ducting system 22, both of FIG. 2.

While a preferred embodiment of the invention has been shown and described, other embodiments will now become apparent to those skilled in the art. Accordingly, this invention is not to be limited to that which is shown and described but by the following claims.

What is claimed is:

1. A compact washing unit for serially washing articles each having top and bottom face surfaces bounded by opposing side edges and forward and rearward edges comprising, a. a fluid containment housing having an article entrance opening and an article exit opening for the delivery of articles into said housing and the egress of articles from said housing, b. a stationary fluid directing article washing station fixed within said housing operatively connected to a source of pressurized washing water having upwardly extending water conducting portions laterally spaced from one another, each of said portions having washing water outlets spaced from one another for cooperatively directing streams of washing water onto the face surfaces of said articles when said articles are moved through said washing station, c. a stationary fluid directing article rinsing station fixed within said housing at a spaced longitudinal position from said stationary washing station operatively connected to a source of pressurized rinsing water, said rinsing station having upwardly extending water conducting portions laterally spaced from one another, each of said last mentioned portions having rinsing water outlets spaced from one another for cooperatively directing streams of pressurized rinsing water onto the face surfaces of said articles when said articles are moved through said rinsing station, d. upper and lower article receiving and guide tracks secured in alignment with one another in said housing extending in a discrete linear path from said entrance opening to said exit opening and between the upwardly extending water conducting portions of said stationary washing and rinsing stations therein, each of said tracks having a central web portion and opposing side flanges for receiving and embracing the opposing side edges of said articles to thereby securely support said articles by their side edges in an upright manner and in serial alignment with one another with the rearward edge of an article being washed in said unit adapted to be physically engaged by the forward edge of a subsequent article to be washed in said unit so that said article being washed can be moved on said guide track completely through said unit by manually moving said subsequent article into said housing.

2. The compact washing unit of claim 1, wherein said articles are similar in shape and thickness and further comprising a pair of laterally spaced and upwardly extending scrubbing brushes mounted in said housing between said washing and rinsing stations to provide an article scrubbing station and to provide the sole partition separating said washing and rinsing stations from one another, said scrubbing brushes having sets of inwardly extending and unencumbered bristles which fully interface with one another to define a confining passageway therebetween dimensioned less than the thickness of said articles so that said bristles scrub and clean the entire extent of said top and bottom surfaces of said articles.

3. The compact washing unit of claim 2, and further comprising a discrete article drying station fixed within said housing through which guide tracks extend, said drying station including air conducting duct work means for directing drying air across the face surfaces of said articles before said articles are removed from said exit opening and a liquid drain leading from said housing for conducting used washing and rinsing water from said housing.

4. A compact sanitizing unit for washing, rinsing and drying articles bounded by opposing side edges and forward and rearward edges comprising, a. a housing, b. said housing having an article entrance opening for admitting a series of said articles therein and having a separate article exit opening for the egress of said articles, c. a stationary article washing station fixed within said housing operatively connected to a source of pressurized washing water and having discrete fluid outlets for directing streams of pressurized washing water onto said article when in said washing station, d. a stationary rinsing station fixed within said housing at a position spaced from said washing station operatively connected to a source of pressurized rinsing water and having discrete fluid outlets for directing streams of pressurized rinsing water onto said articles when in said rinsing station, e. a discrete article drying station fixed within said housing serially spaced from said washing and rinsing stations having duct work for conducting forced drying air across said articles, f. upper and lower article receiving tracks vertically aligned with one another and extending completely through said housing from said article entrance opening through said washing, rinsing and drying stations to said article exit opening for embracing the side edges of said article so as to mount the articles in an edge supported and upright position and in a train in which said articles are sequentially washed, rinsed and dried by said unit, g. said tracks being partially U-shaped in cross-section for partially encapsulating said side edges of said articles to physically engage and guide said articles in alignment as they are serially moved through said housing.

5. The washing unit of claim 4, wherein said washing station is defined by a first endless tubular manifold extending completely around said article being washed and said rinsing station is defined by a second endless tubular manifold extending completely around said article being rinsed, and further including a pair of opposing brushes for contacting said opposing surfaces of said article providing an article scrubbing station rigidly secured between and to said washing and rinsing manifolds and forming the only structure which separates said washing and rinsing stations of said unit.

6. The compact washing unit of claim 4, and further comprising an external hopper operatively attached to said housing and extending beneath said exit opening for catching and stacking said trays.

7. A compact washing unit for sanitizing flattened and generally rectilinear serving trays bounded by opposing side edges and forward and rearward edges comprising, a. a housing, b. a loading station for said trays external of said housing, c. a stationary tray washing station fixed within said housing operatively connected to a source of pressurized washing water and having discrete fluid outlets for directing streams of pressurized washing water onto said tray when in said pressurized washing station, d. a scrubbing station having a pair of scrub brushes with interfacing bristles mounted in said housing, e. a rinsing station fixed within said housing at a position spaced from said scrubbing station operatively connected to a source of pressurized rinsing water and having discrete fluid outlets for directing streams of pressurized rinsing water onto said trays when in said rinsing station, f. a drying station fixed within said housing at a position spaced from said rinsing station operatively connected to a source of heated drying air for drying said trays, g. bracket means securing said washing and rinsing stations to one another and for securely holding said scrub brushes therebetween, h. upper and lower article receiving tracks extending from said loading station extending completely through said housing and washing, scrubbing, rinsing and drying stations therein, said tracks having U-shaped cross-section in parts and having opposing inwardly extending flanges for contacting and receiving opposing the side edges of said trays so as to securely mount said trays in an edge supported and upright position and in a series in which one of said trays follows the other, i. an exit opening formed in said housing for said trays aligned with said tracks at the end of said drying station.

* * * * *